US006189296B1

(12) United States Patent
Spatafora et al.

(10) Patent No.: US 6,189,296 B1
(45) Date of Patent: Feb. 20, 2001

(54) METHOD AND MACHINE FOR PACKING A PRODUCT

(75) Inventors: Mario Spatafora; Fabrizio Tale', both of Bologna (IT)

(73) Assignee: G. D Societa' per Azioni, Bologna (IT)

( * ) Notice: Under 35 U.S.C. 154(b), the term of this patent shall be extended for 0 days.

(21) Appl. No.: 09/247,741

(22) Filed: Feb. 9, 1999

(30) Foreign Application Priority Data

Feb. 13, 1998 (IT) ..... BO98A0077

(51) Int. Cl.[7] ..... B65B 11/00
(52) U.S. Cl. ..... 53/461; 53/228; 53/234
(58) Field of Search ..... 53/461, 464, 462, 53/234, 225, 232, 228, 218, 209, 207, 253, 251, 564, 566; 493/911, 910

(56) References Cited

U.S. PATENT DOCUMENTS 3,992,855 * 11/1976 Palmieri et al. ..... 53/209 X
5,129,209 * 7/1992 Focke ..... 53/234 X
5,168,690 * 12/1992 Quadrana ..... 53/234 X
5,771,666 * 6/1998 Bertuzzi et al. ..... 53/234 X

FOREIGN PATENT DOCUMENTS 2225564 6/1990 (GB) .

* cited by examiner

*Primary Examiner*—Eugene Kim
(74) *Attorney, Agent, or Firm*—Ladas and Parry

(57) ABSTRACT

A method and machine for packing a product—in the example shown, a group of cigarettes—in a blank of packing material, whereby the blank is fed to a first seat on a packing conveyor, the product is fed to a second seat on the same packing conveyor, and a relative movement is imparted to the two seats to form, in one of the two seats, a blank-product assembly.

26 Claims, 3 Drawing Sheets

1
2
3
4
5
5a
6
7
8
9
10
11
12
13
22
24
27
36
37
38
39
40
41
42
43
44
45
46
47
48
P

METHOD AND MACHINE FOR PACKING A PRODUCT

FIELD OF THE INVENTION

The present invention relates to a method of packing a product.

BACKGROUND OF THE INVENTION

In the following description, reference is made purely by way of example to the packing industry, and in particular to cigarette packing machines for producing rigid hinged-lid packets of cigarettes, and on which a finished packet is normally formed by folding a preweakened blank of cardboard about a respective group of cigarettes wrapped in a sheet of foil material.

In the cigarette packing industry, it is common practice to us step-operated packing machines on which a blank is normally folded about a respective group of cigarettes as the group of cigarettes is transferred between the seats of successive packing wheels. In particular, a first folding operation, during which the blank assumes a substantially U-shaped configuration about the group of cigarettes, is normally performed by transferring the group of cigarettes from one seat on one wheel to a corresponding seat on a follow-up wheel, and by interposing the blank between the group and the seat on the follow-up wheel.

On step-operated packing machines, folding blanks about respective groups by transferring the groups between successive wheels is, mechanically speaking, fairly straightforward, seeing as the two corresponding seats of the two successive wheels are kept facing each other for a given time interval between successive operating steps of the wheels. Functionally speaking, however, folding the blanks as described above involves serious drawbacks on account of the ever-increasing operating speed of modern step-operated packing machines continually reducing the time interval and so increasing the likelihood of the blanks being damaged or folded incorrectly.

On continuous packing machines, folding the blanks by transferring the groups between successive wheels poses fewer operating problems, but seriously complicates the structure of the machine by requiring pairs of packing wheels comprising movable seats, and wherein each seat on each wheel is related dynamically to a corresponding seat on another wheel. That is, for a folding operation to be performed, two corresponding seats—one on one wheel and the other on a follow-up wheel—must be kept facing each other for a given length of time, while moving at least one of the two corresponding seats with respect to the relative wheel.

SUMMARY OF THE INVENTION

It is an object of the present invention to provide a packing method which is straightforward and cheap to implement in general, and in particular when using a continuous packing machine, and which at the same time provides for high-quality folding and high-speed performance.

According to the present invention, there is provided a method of packing a product in at least a first sheet of packing material; the method comprising the steps of feeding the first sheet to a first seat on a packing conveyor; feeding the product to a second seat on the same packing conveyor; and imparting a relative movement to said two seats to form, in one of said two seats, a first sheet-product assembly.

The present invention also relates to a machine for packing a product.

According to the present invention, there is provided a machine for packing a product in at least a first sheet of packing material, the machine comprising a packing conveyor; at least one first seat located on said packing conveyor to receive and retain said first sheet; at least one second seat located on said packing conveyor to receive and retain said product; and actuating means for imparting a relative movement to said two seats to form, in one of said two seats, a first sheet-product assembly.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
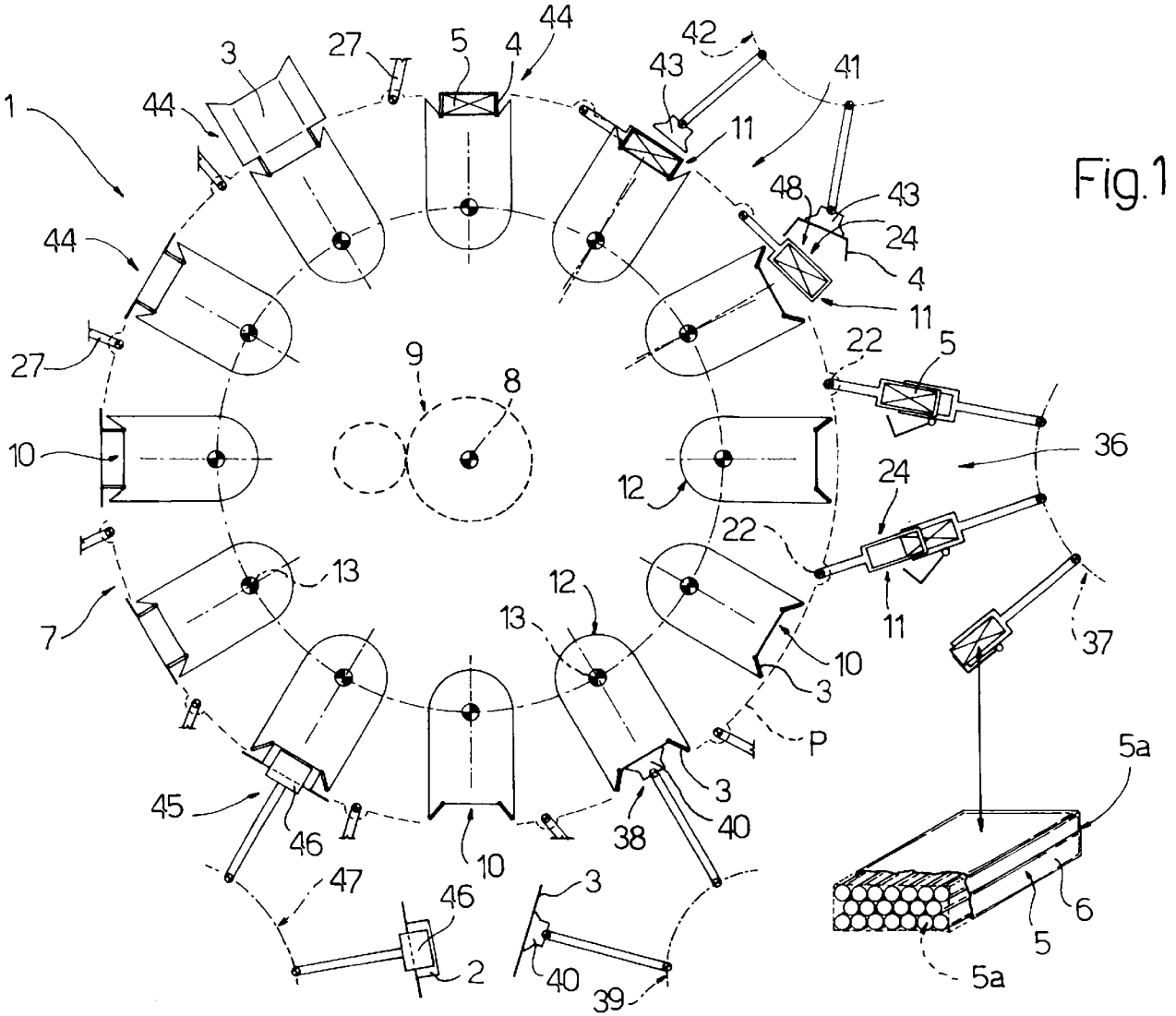
FIG. 1 shows a schematic partial front view, with parts removed for clarity, of a preferred embodiment of the machine according to the present invention.

Numeral 1 in FIG. 1 indicates as a whole a cigarette packing machine for producing rigid hinged-lid packets 2. As is known, packets 2 are formed by folding a blank 3 and a collar 4 about a group 5 of cigarettes, which is normally wrapped in a sheet 6 of foil, and is normally in the form of an elongated parallelepipedon having two opposite, substantially parallel longitudinal ends 5*a*.

Packing machine 1 operates continuously, and comprises a packing wheel 7 rotating about an axis 8 perpendicular to the FIG. 1 plane, and which is rotated continuously about axis 8 by a known actuating assembly 9. Packing wheel 7 comprises a first and a second orderly number of peripheral seats indicated at 10 and 11 respectively; and each two adjacent seats 11 are located on either side of a seat 10.

Each seat 11 receives and conveys a respective group 5 of cigarettes, while each seat 10 first receives and conveys a respective blank 3 partially folded substantially into a U, and later also receives and conveys a respective group 5 of cigarettes and a respective collar 4.

Figure 2:
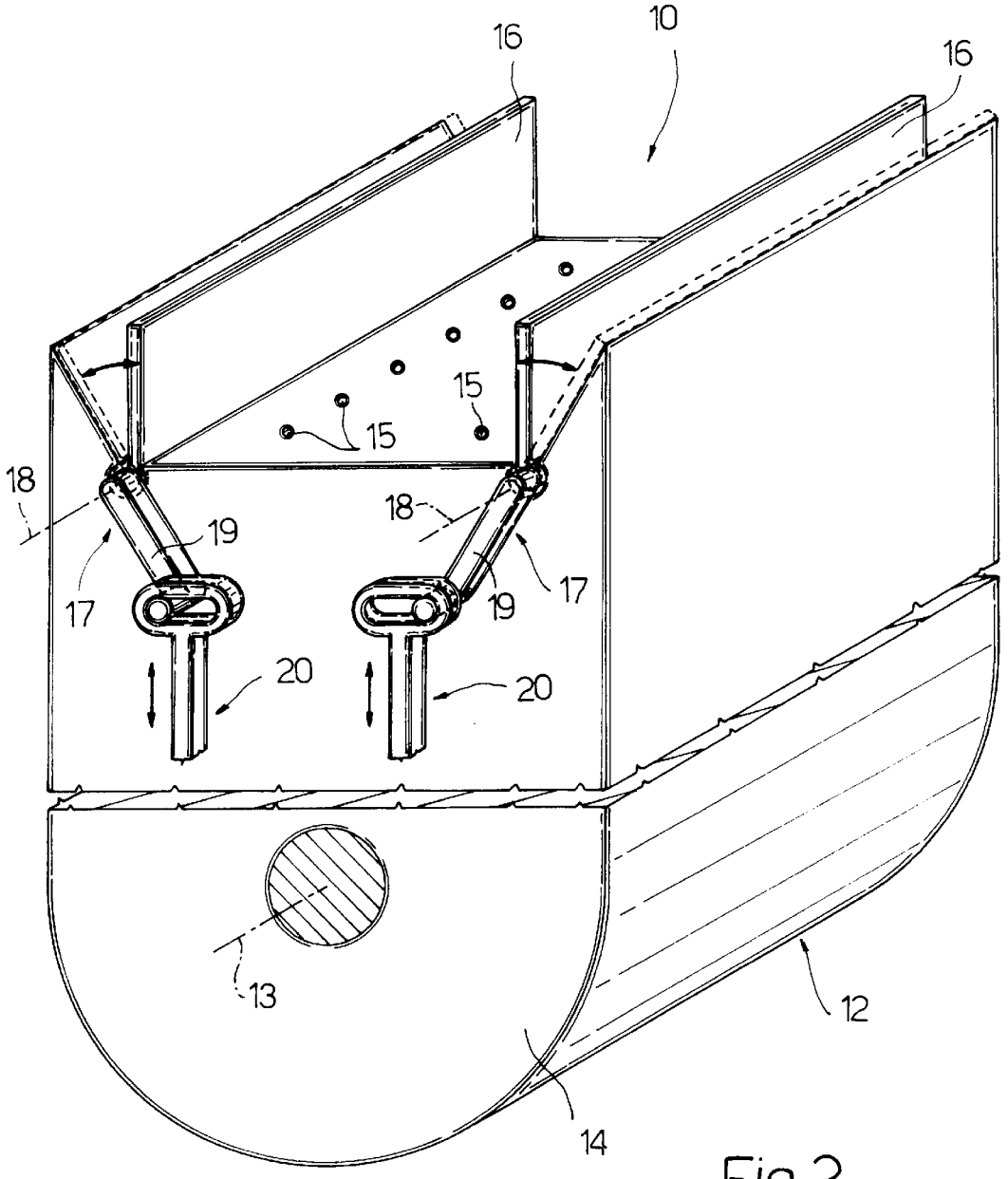
FIG. 2 shows a larger-scale schematic view in perspective of a first detail in FIG. 1.

As shown in FIG. 2, each seat 10 is formed on a respective support 12, which is fitted to packing wheel 7, and which is oscillated about a respective axis 13 parallel to axis 8 and according to a given law of motion by a known cam actuating device (not shown), which imparts to support 12 a given angular position about respective axis 13 for each angular position assumed by axis 13 about axis 8 as packing wheel 7 rotates.

Support 12 comprises a base body 14 with a number of through holes 15 connected to a known suction device (not shown) on packing wheel 7; and two lateral walls 16 parallel to axis 8 and on either side of base body 14. Each lateral wall 16 defines a first arm of a respective rocker arm 17, which is hinged to support 12 to oscillate, with respect to base body 14 and about a respective axis 18 parallel to axis 8, between an open position and a closed position indicated respectively by a dash line and a continuous line in FIG. 2. For this purpose, rocker arm 17 comprises a second arm 19 connected to a respective known link-block actuating device 20 controlled by a system of fixed cams (not shown) and activated by the rotation of packing wheel 7 about axis 8.

When rocker arms 17 are set to the open position, the two lateral walls 16 of seat 10 form an obtuse angle with an outer surface of base body 14, so that seat 10 has a section in the form of an isosceles trapezium with the shorter of the opposite sides coincident with the outer surface of base body 14. Conversely, when rocker arms 17 are set to the closed position, the two lateral walls 16 of seat 10 substantially form a right-angle with the outer surface of base body 14, so that seat 10 has a rectangular section substantially identical to that of a group 5 of cigarettes.

Figure 3:
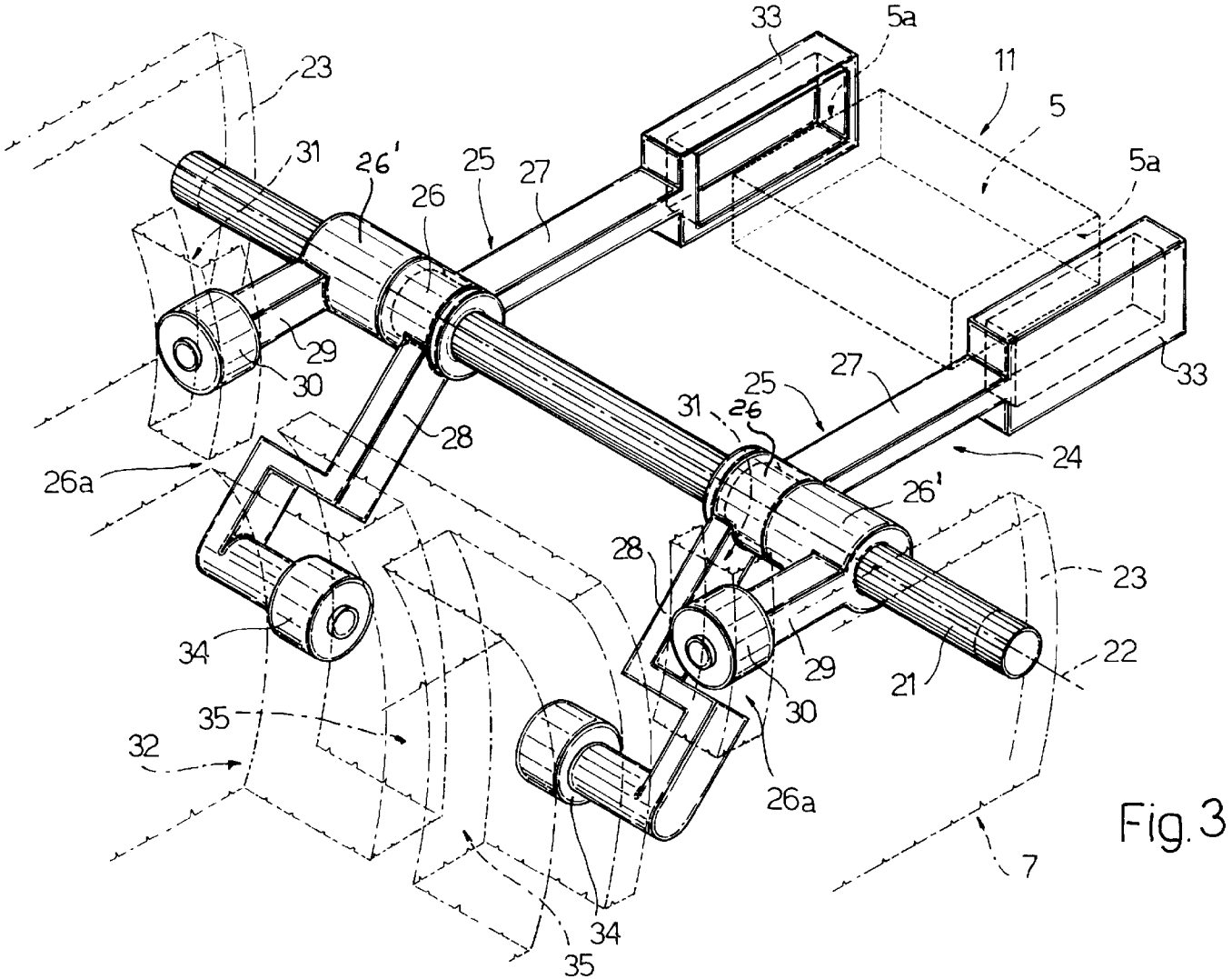
FIG. 3 shows a larger-scale schematic view in perspective of a second detail in FIG. 1.

As shown in FIG. 3, each second seat 11 is associated with a respective pin 21 having an axis 22 parallel to axis 8, and supported at opposite ends by two end plates 23 forming part of wheel 7 and perpendicular to axis 8. Each seat 11 is defined by a respective gripping device 24 for engaging the opposite longitudinal ends 5*a* of a respective group 5 of cigarettes, and which comprises two rocker arms 25, each of which is hinged about axis 22 and, in turn, comprises a central sleeve 26 fitted in rotary and axially-sliding manner to pin 21, and two arms 27 and 28 extending radially from sleeve 26.

The angular and axial positions of each sleeve 26 are controlled by a respective actuating and control device 26*a*, which comprises a sleeve 26' fitted in rotary and axially-sliding manner to pin 21 and contacting sleeve 26. Sleeve 26' comprises an arm 29 projecting radially from sleeve 26' and fitted on the free end with a tappet roller 30 rotating about a respective axis perpendicular to axis 22, and engaging a track 31 of a fixed cam 32 located between plates 23 and forming part of device 26*a*. Device 26*a* also comprises known elastic members (not shown) for maintaining contact between each sleeve 26 and respective sleeve 26'. Track 31 extends about axis 8 to control the axial position of sleeve 26 along pin 21 alongside variations in the angular position of seat 11 about axis 8. Each arm 27 is fitted on the free end with a respective cup-shaped half-shell 33, which is positioned facing the half-shell 33 on arm 27 of the other rocker arm 25 to define respective seat 11, and which provides for receiving a respective longitudinal end 5*a* of respective group 5 of cigarettes. Each arm 27 is of such a length that, by rotating arm 27 about axis 22 of pin 21, respective half-shell 33 is movable into an unloading position in which half-shell 33 engages the seat 10 immediately upstream in the rotation direction of wheel 7.

Actuating and control device 26*a* of each sleeve 26 also comprises a tappet roller 34 fitted in rotary manner to the free end of arm 28 to rotate about a respective axis, parallel to axis 22, inside a respective track 35, which is formed on cam 32 and extends about axis 8 to control the angular position of sleeve 26 about axis 22 of pin 21 alongside variations in the angular position of seat 11 about axis 8.

Track 31 of cam 32 is so formed that, as wheel 7 rotates about axis 8, the two rocker arms 25 of each seat 11 are moved, along axis 22 of respective pin 21, between a position opening respective gripping device 24—wherein the two half-shells 33 are separated by a distance greater than the length of a respective group 5 of cigarettes—and a position closing respective gripping device 24—wherein the two half-shells 33 define respective seat 11 and provide for gripping and retaining a respective group 5 with the respective cigarettes oriented parallel to axis 8.

Track 35 of cam 32 is so formed that, as wheel 7 rotates about axis 8, the two rocker arms 25 of each seat 11 are rotated, about axis 22 of respective pin 21, between a loading position—wherein respective gripping device 24, traveling with wheel 7 along a substantially circular path P through an unloading station 36, receives a respective group 5 of cigarettes from a known supply wheel 37—and an unloading position—wherein respective gripping device 24 is positioned with respective half-shells 33 inside the seat 10 immediately upstream in the rotation direction of wheel 7.

In addition to loading station 36, path P—along which seats 10 also substantially travel—also extends through a further loading station 38, where each seat 10 receives a respective blank 3 from a known supply wheel 39 comprising a number of conveying heads 40, each for conveying a respective blank 3 and penetrating a respective seat 10 at loading station 38.

Path P also extends through a further loading station 41 located on the opposite side of station 36 to station 38, and where wheel 7 cooperates with a further supply wheel 42 having a number of conveying heads 43, each for conveying a respective collar 4 substantially folded into a U, and for fitting collar 4 onto a respective group 5 at station 41.

Path P also extends through at least one folding station 44 located downstream from station 41, and where each blank is gradually folded in known manner (not shown) about respective group 5 to form a respective packet 2; and through an unloading station 45 where the substantially finished packets 2 are extracted successively in known manner from respective seats 10 by respective conveying heads 46 of a known unloading wheel 47.

Operation of machine 1 will now be described with reference to one pair of adjacent corresponding seats 10 and 11 (i.e. a pair of adjacent seats 10 and 11, in which seat 11 precedes seat 10 in the rotation direction of packing wheel 7), and as of the instant in which seat 10, traveling with seat 11 about axis 8, reaches loading station 38.

As seats 10 and 11 travel through loading station 38, wheel 39 rotates continuously about its own axis to feed a conveying head 40, together with a respective flat blank 3, through loading station 38 in time with and at the same speed as seat 10, the lateral walls 16 of which are set to the open position. At station 38, head 40 gradually penetrates seat 10 to gradually fold blank 3 into a U and deposit a central portion of blank 3 onto the outer surface of base body 14, on which blank 3 is retained in the U-folded configuration by suction through holes 15.

As seats 10 and 11 travel through loading station 36, wheel 37 rotates continuously about its own axis to feed a group 5 of cigarettes through loading station 36 in time with and at the same speed as seat 11. At station 36, group 5 is gradually inserted between half-shells 33 of gripping device 24, which is set to the loading position and closes gradually onto the opposite longitudinal ends 5*a* of group 5 to grip and remove group 5 off wheel 37. Through station 36 also, the lateral walls 16 of seat 10 are kept in the open position.

As seats 10 and 11 subsequently travel between loading stations 36 and 41, devices 26*a* move gripping device 24 and seat 11 from the loading to the unloading position, in which the two half-shells 33, together with respective group 5, are inserted inside seat 10 to form a blank-product assembly 48 wherein blank 3 is folded into a U and houses group 5 still located inside seat 11.

Through station 41—in which gripping device 24 is set to the closed position and the lateral walls 16 of seat 10 to the open position—assembly 48 is completed by the addition of collar 4, which has already been folded partially into a U in known manner, and is gradually fitted onto a central portion, left free by half-shells 33, of group 5 by a conveying head 43, which travels through station 41 in time with and at the same speed as seat 10.

At this point, gripping device 24 is opened and moved into the loading position to release group 5 inside seat 10, while lateral walls 16 of seat 10 are moved into the closed position to retain group 5 and respective collar 4 inside seat 10. Assembly 48 is then fed by wheel 7 through folding stations 44 to unloading station 45.

Though machine 1 is advantageously a continuously-operating machine, the above also applies to noncontinuous machines, by providing, regardless of whether packing wheel 7 rotates continuously or not, for reducing the number of components by performing on one packing wheel operations which, on known machines, would require at least two successive packing wheels, thus reducing the size and cost of the machine in general.

Moreover, the particular structure of wheel 7, and the possibility of feeding a blank 3 and respective group 5 into respective seats 10 and 11 on the wheel itself, and of inserting, on wheel 7 itself, each seat 11 inside the corresponding seat 10 to form assembly 48 inside seat 10, provide for making the traveling speed of wheel 7 substantially independent of the speed at which group 5 of cigarettes is inserted inside respective blank 3.

In a further embodiment, seat 10 is movable and seat 11 fixed with respect to packing wheel 7, and a group 5 of cigarettes carried in seat 11 is inserted inside a blank 3 carried in seat 10 by moving first seat 10.

In a further embodiment not shown, both seats 10 and 11 are movable with respect to packing wheel 7, and a group 5 of cigarettes carried in seat 11 is inserted inside a blank 3 carried in seat 10 by simultaneously moving seats 10 and 11.

Though seats 10 and 11, in the embodiment shown, are carried on a packing conveyor in the form of a wheel defined by packing wheel 7, other types of packing conveyor may be used, such as that described in Patent WO 97/03878 and defined by an endless belt.

Though designed in the embodiment shown for producing rigid hinged-lid packets of cigarettes, packing machine 1 may, in other embodiments, produce other types of packets, such as rigid non-hinged-lid packets of cigarettes (in which case, the collars are dispensed with), or soft packets of cigarettes (in which case, the collars are dispensed with and the blank is replaced by a sheet of wrapping material).

In one particular embodiment not shown, packing machine 1 is a cellophaning machine, in which case, the collars are dispensed with, the blank is replaced by a sheet of plastic wrapping material, and group 5 of cigarettes is replaced by a packet of cigarettes.

In further embodiments, movable walls 16 of seat 10 are replaced by fixed walls, and group 5 is retained solely by suction or by other mechanical means associated with seat 10.

In yet a further embodiment, lateral walls 16 of seat 10 are movable, not by rotating about respective axes 18, but by simply translating parallel to themselves.

What is claimed is:

1. A method of packing a product in at least a first sheet (3) of packing material; the method comprising the steps of feeding the first sheet (3) to a first seat (10) on a packing conveyor (7); feeding the product (5) to a second seat (11) on the same packing conveyor (7); and imparting a relative movement to said two seats (10, 11) to insert one of said two seats (10, 11), into the other of said two seats (10, 11) and form in said other of said two seats a first sheet-product assembly (48).

2. A method as claimed in claim 1, wherein said first sheet (3) is folded partially to assume a substantially U-shaped configuration as the first sheet (3) is fed to said first seat (10).

3. A method as claimed in claim 1, wherein said assembly (48) is formed by a movement of said second seat (11) from a normal loading position for receiving said product, to an unloading position in which said second seat (11) engages said first seat (10).

4. A method as claimed in claim 3, wherein said movement is performed by rotating said second seat (11) about an axis (22) moving with said conveyor (7).

5. A method as claimed in claim 1, wherein said product (5) is an elongated product having two opposite longitudinal ends **(5*a* ); each said product (5) being engaged by the respective said second seat (11) by said two longitudinal ends (5*a* )**.

6. A method as claimed in claim 3, and comprising the further steps of releasing said product (5), after said movement, inside said first seat (10); and restoring the empty said second seat (11) to said loading position.

7. A method as claimed in claim 1, and comprising a further step of assigning said assembly (48) a second sheet (4) of packing material.

8. A method as claimed in claim 3, and comprising a further step of assigning said assembly (48) a second sheet (4) of packing material when said second seat (11) is in said unloading position.

9. A method as claimed in claim 1, wherein said first seat (10) is defined by a base body (14), and by two lateral walls (16) movable between a first open position and a second closed position; said two lateral walls (16) being maintained in said first open position during supply of said first sheet (3) and formation of said assembly (48), and then being moved into said second closed position to retain said assembly (48).

10. A method as claimed in claim 9, and comprising a further step of assigning said assembly (48) a second sheet (4) of packing material when said two lateral walls (16) are set to said first open position.

11. A method as claimed in claim 1, wherein said first sheet (3) of packing material is a blank (3), and said product (5) comprises a group (5) of cigarettes.

12. A method as claimed in claim 7, wherein said first sheet (3) of packing material is a blank (3), said second sheet (4) is a collar (4), and said product (5) comprises a group (5) of cigarettes.

13. A method as claimed in claim 1, wherein said product (5) comprises a group (5) of cigarettes wrapped in a sheet (6) of foil.

14. A method as claimed in claim 1, wherein said packing conveyor (7) is operated substantially continuously.

15. A method as claimed in claim 1, wherein said packing conveyor (7) is a packing wheel (7) rotated about a fixed axis (8).

16. A machine for packing a product in at least a first sheet (3) of packing material, the machine comprising a packing conveyor (7); at least one first seat (10) located on said packing conveyor (7) to receive and retain said first sheet (3); at least one second seat (11) located on said packing conveyor (7) to receive and retain said product (5); and actuating means **(26*a*) for imparting a relative movement to said two seats (10, 11) to insert one of said two seats (10, 11) into the other of said two seats and form in said other of said two seats a first sheet-product assembly (48)**.

17. A machine as claimed in claim 16, wherein said first seat (10) is fixed with respect to said packing conveyor (7), and said second seat (11) is movable with respect to said packing conveyor (7) from a normal loading position for receiving said product (5), to an unloading position in which said second seat (11) engages said first seat (10).

18. A machine as claimed in claim 17, wherein said second seat (11) is fitted to said packing conveyor (7) to rotate about a respective axis (22) moving with the packing conveyor (7).

19. A machine as claimed in claim 18, and comprising, for each said second seat (11), a gripping device (24) in turn comprising two opposed half-shells (33); said actuating means (26*a*) being connected to said two half-shells (33) to move the two half-shells (33) to and from a closed position in which the two half-shells (33) define the respective second seat (11).

20. A machine as claimed in claim 16, wherein said first seat (10) is movable with said packing conveyor (7) along a path (P) extending through a first loading station (38) for loading said first sheet (3), and a following second loading station (41) for loading a second sheet (4) of packing material.

21. A machine as claimed in claim 16, wherein said first seat (10) comprises a base body (14); two lateral walls (16) movable, with respect to each other and with respect to said packing conveyor (7), between a first open position and a second closed position; and activating means (20) for maintaining said two lateral walls (16) in said first open position during supply of said first sheet (3) and formation of said assembly (48), and for moving said two lateral walls (16) into said second closed position to retain said assembly (48) inside the first seat (10).

22. A machine as claimed in claim 21, wherein each of said movable lateral walls (16) forms, with said base body (14), an obtuse angle in said first open position, and substantially a right angle in said second closed position.

23. A machine as claimed in claim 16, wherein said packing conveyor (7) comprises a packing wheel (7) rotating about a respective fixed axis (8).

24. A machine as claimed in claim 16, and comprising drive means (9) for moving said packing conveyor (7) substantially continuously.

25. A method of packing a product in at least a first sheet (3) of packing material; the method comprising the steps of feeding the first sheet (3) to a first seat (10) on a packing conveyor (7); feeding the product (5) to a second seat (11) on the same packing conveyor (7); and imparting a relative movement to said two seats (10, 11) to form, in one of said two seats (10, 11), a first sheet-product assembly (48), wherein said product (5) is an elongated product having two opposite longitudinal ends (5*a* ); each said product (5) being engaged by the respective said second seat (11) by said two longitudinal ends (5*a* ).

26. A machine for packing a product in at least a first sheet (3) of packing material, the machine comprising a packing conveyor (7); at least one first seat (10) located on said packing conveyor (7) to receive and retain said first sheet (3); at least one second seat (11) located on said packing conveyor (7) to receive and retain said product (5); and actuating means (26*a*) for imparting a relative movement to said two seats (10, 11) to form, in one of said two seats (10, 11), a first sheet-product assembly (48), wherein said second seat (11) is fitted to said packing conveyor (7) to rotate about a respective axis (22) moving with the packing conveyor (7).

* * * * *